United States Patent [19]

McIntyre

[11] 4,321,737

[45] Mar. 30, 1982

[54] GUNSMITH'S TOOL

[76] Inventor: Jack McIntyre, P.O. Box 491, Troy, N.C. 27371

[21] Appl. No.: 134,028

[22] Filed: Mar. 26, 1980

[51] Int. Cl.[3] ..... B23P 13/00

[52] U.S. Cl. ..... 29/1.1; 29/76 R; 51/241 S

[58] Field of Search ..... 29/1.1, 1.11, 76 R; 408/80; 51/241 S, 241 VS, 168, 170 T

[56] References Cited

U.S. PATENT DOCUMENTS

| | | | |
|---|---|---|---|
| 640,518 | 1/1900 | Adelman | 29/1.1 |
| 992,437 | 5/1911 | Metcalf . | |
| 2,180,640 | 11/1939 | Mikalson | 51/241 S |
| 2,414,731 | 1/1947 | Forbes, Jr. | 51/241 S |
| 2,636,325 | 4/1953 | Livingston et al. | 51/241 VS |
| 2,802,319 | 8/1957 | Hume | 51/241 S |
| 3,532,010 | 10/1970 | Klintworth . | |
| 3,942,289 | 3/1976 | Greer | 51/241 VS |
| 3,999,452 | 12/1976 | Larsen | 408/80 X |

OTHER PUBLICATIONS

"Shooting Industry", Jul. 1981, (ISSN 0037-4148), Pub. by Publisher's Development Corp., San Diego, Calif., pp. 4, 23 and 24.

*Primary Examiner*—Horace M. Culver
*Attorney, Agent, or Firm*—Joseph H. Heard

[57] ABSTRACT

The tool includes a rotatable shank having a guide member releasably mounted upon its lower portion and adapted to be closely received within the muzzle portion of a gun barrel, and further includes a file member projecting radially outwardly from a medial portion of the shank and rotatable in unison with it. The file member overlies and engages the muzzle end surfaces of the barrel and, upon rotation of the shank of the tool, it "squares" and otherwise finishes such surfaces. The means by which the file member is mounted preferably is of a releasable type that includes a supportive backing member. The extent of the radial projection of the file member from the shank preferably is such that when the tool is used in association with a double-barreled firearm, it simultaneously finishes all of the muzzle end surfaces thereof.

8 Claims, 4 Drawing Figures

GUNSMITH'S TOOL

BACKGROUND OF THE INVENTION

This invention relates to gunsmith's tools, and more particularly relates to a tool by which a gunsmith may more precisely and efficiently perform surface-finishing work upon the muzzle of a shotgun or similar firearm.

A substantial part of the average gunsmith's business activity is devoted to shortening the barrels of firearms brought to him by customers. In the case of firearms of the shotgun type, this is necessary when the customer desires to change the "choke" of his gun, either merely by reducing the barrel length or by the addition of a POLYCHOKE® or similar muzzle device to it. In both of the foregoing cases the gunsmith must first cut off a portion of the muzzle of the gun's barrel, which step is customarily performed by use of a lathe or the like, and then must hand-finish the cut end surface of the muzzle for the purpose of smoothing the same and of producing a "square" (i.e., perpendicular) relationship between it and the barrel's axis. The finishing may at times also include some further shortening of the barrel to bring it to precisely the desired reduced length. When the foregoing muzzle-finishing work is done by the use of a conventional metal-cutting file, as is now the customary practice, it is exceedingly laborious and time-consuming. It requires considerable alternate filing and gauging, and even then frequently fails to produce a precisely "square" muzzle surface.

DESCRIPTION OF THE PRIOR ART

While not pertaining to tools used by gunsmiths for the finishing of gun muzzles, the following U. S. patents disclose tools usable in association with generally cylindrical work of diverse types: U.S. Pat. Nos. 3,942,289, 3,870,429, 3,532,010, 2,598,765, 1,988,411, 1,946,416, 1,839,391, 1,715,546 and 992,437.

SUMMARY OF THE INVENTION

The gunsmith's tool of the present invention comprises an elongate shank that is rotatable about its central axis by means upon one of its end portions. Upon its opposite end portion the shank has a generally cylindrical guide member closely receivable within the barrel of a firearm whose muzzle is to be finished. File means, which preferably is in the form of a disc-like member having filing teeth upon its bottom surface, is connected to and rotatable with a medial portion of the shank of the tool and projects radially outwardly therefrom into overlying engagement with the muzzle end surfaces of a gun barrel within which the guide member is received. The guide member insures that the teeth upon the disc-like member "square" the muzzle end surfaces, as well as otherwise finish the same, when the shank of the tool is rotated.

In a preferred embodiment both the file means and the guide member of the tool are releasably secured to its shank, and the radial projection of the file means from the shank is sufficiently great for it to simultaneously overlie and finish the muzzle end surfaces of both barrels of a double-barreled gun.

DESCRIPTION OF THE DRAWING

Other features and benefits of the invention will be apparent from the following description of an illustrative embodiment thereof, which should be read in conjunction with the accompanying drawings, in which.

DESCRIPTION OF THE PREFERRED EMBODIMENT

Figure 1:
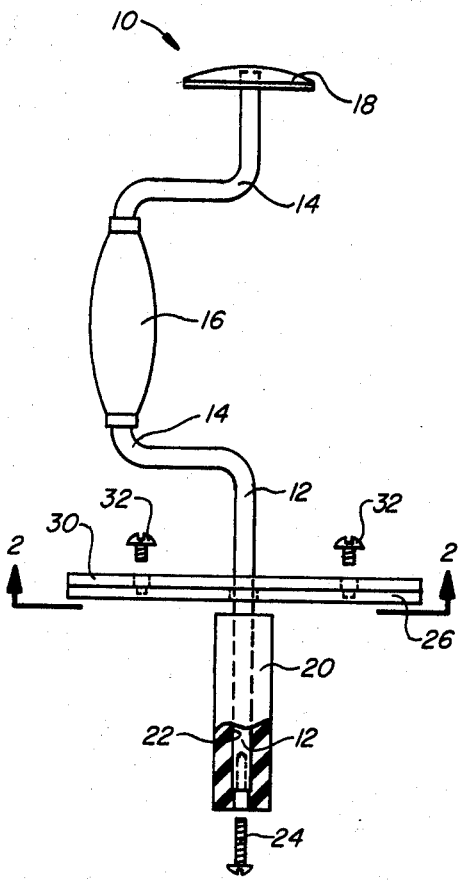
FIG. 1 is a partially-exploded side elevational view of a gunsmith's tool in accordance with the invention, one component of the tool being partially broken away.

In FIG. 1 of the drawings the numeral 10 designates a gunsmith's tool having an elongate shank 12 adapted to be rotated about its longitudinal axis by drive means upon its upper end portion. The drive means illustratively comprises a manually operable crank-like member 14 formed integrally with shank 12 and having handle members 16, 18 that are grasped and manipulated, in a well known manner, by a person using the tool. A generally cylindrical "pilot" or guide member 20, preferably and illustratively formed of nylon or similar smooth and wear-resistant plastic material, is releasably mounted upon and in concentric encircling relationship with the lower end portion of shank 12. More specifically, the lower end portion of shank 12 is closely received within and abuts the bottom of a blind bore 22 extending centrally of guide member 20 and opening from its upper end. A smaller diameter bore extends centrally through the bottom of guide member 20 and is aligned with a threaded bore within the bottom of shank 12. The aforesaid bores receive a screw-type fastener 24 which, when tightened, prevents displacement of member 20 from shank 12. Member 20 is adapted to be closely and concentrically received within the muzzle end portion of the barrel of a firearm, and its outer diameter therefore is only slightly less than the inner diameter of such barrel portion. Additional guide members, not shown in the drawings but corresponding to the illustrated member 20 except for their having differing outer diameters, preferably are provided so that the one of appropriate corresponding size may be mounted upon shank 12 when tool 10 is used in association with a firearm having a different muzzle diameter. Substitution of another guide member for member 20 may be easily accomplished simply by removing fastener 24, sliding member 20 from shank 12, and then mounting the substitute guide member upon the shank in the same manner.

Filing means, illustratively in the form of a flat disc-like member 26 having file teeth 28 upon substantially all of its undersurface, extends in concentric relationship to and projects radially outwardly from a medial portion of shank 12. Member 26 is releasably connected to shank 12, for rotation in unison with it, by mounting means that includes a disc-like backing plate 30 fixedly and concentrically secured in any suitable manner upon the aforesaid medial portion of shank 12. A plurality of screw-type fasteners 32 extend through respective ones of a corresponding plurality of bores provided within plate 30 and into aligned threaded bores provided within the upper part of member 26. When fasteners 32 are tightened, the upper surface of member 26 is firmly engaged and fully "backed" by the equal-diameter bottom surface of plate 30. This enables member 26, which usually will be formed of somewhat brittle steel, to better withstand the vertical stresses imposed upon it during use of tool 10. The releasable mounting of member 26 permits the substitution for it of another disc member which may be identical to member 26 or which may have coarser or finer file teeth upon its bottom surface. Such substitution, if desired, may be readily effected following disengagement of fasteners 32 and removal of guide member 20 from shank 12.

The bottom surface of member 26 preferably is spaced vertically from the upper end of guide member 20, as shown in FIG. 1 of the drawing.

Figure 3:
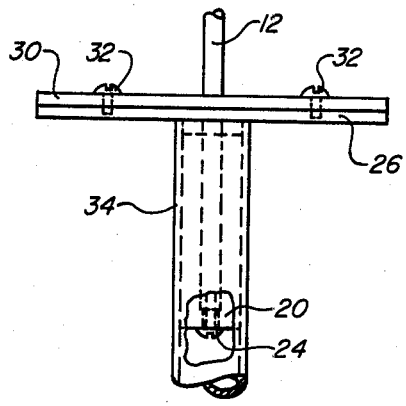
FIG. 3 is a fragmentary elevational view showing components of the tool in operative association with the muzzle of the barrel of a shotgun or similar firearm, the barrel being partially broken away.
Figure 2:
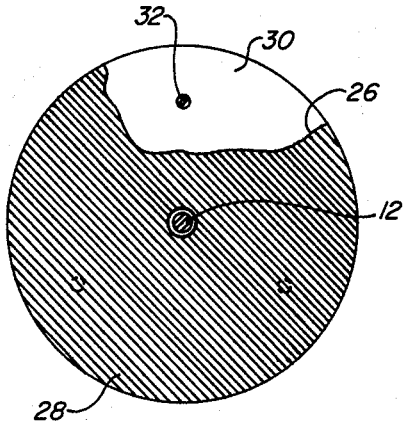
FIG. 2 is a view taken approximately along the line 2—2 of FIG. 1 and showing components of the tool, one of which is partially broken away, in bottom plan and in horizontal cross-section.

Tool 10 may be used to finish the muzzle end surfaces of either single barrel or double-barrel firearms. FIG. 3 of the drawing shows use of tool 10 in association with the barrel 34 of a shotgun of the former type. Guide member 20 has been inserted into the illustrated muzzle end of barrel 34 and tool 10 has been moved downwardly to bring the file teeth 28 upon the bottom surface of member 26 into overlying engagement with the end surface of the barrel's muzzle. The concentric relationship between guide member 20 and barrel 34 insures that the bottom surface of member 26 is perpendicular to the projected longitudinal axis of the barrel. Upon rotation of shank 12 of tool 10, via the previously described drive means shown in FIG. 1 and secured to its upper end portion, the file teeth 28 upon the bottom surface of member 26 therefore precisely "square off" and smoothly finish the muzzle end of barrel 34. If further reduction in the length of barrel 34 should be required, the use of tool 10 is continued until the barrel has been shortened to the desired extent. The previously mentioned vertical spacing between member 26 and guide member 20 permits escape in a radially-inwardly direction, as well as in a radially-outwardly direction, of the metal filings and the like produced during use of tool 10. The smoothness of the nylon or similar material of which guide member 20 is formed prevents the latter from marring the interior surfaces of barrel 34, during use of tool 10, notwithstanding the close fitting relationship between member 20 and the barrel.

Figure 4:
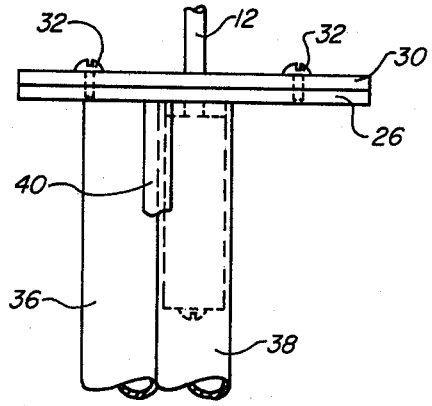
FIG. 4 is a fragmentary elevational view similar to FIG. 3 and showing the same components of the tool in association with the muzzle of a double-barreled shotgun or similar firearm.

FIG. 4 of the drawings shows use of tool 10 in association with the two barrels 36, 38 of a double-barreled shotgun. The diameter of member 26 is sufficiently great that when guide 20 is inserted into either barrel 36 or 38 of such gun, member 26 overlies the end surfaces of both barrels and of a rib-like member 40 customarily secured thereto. Use of tool 10 therefore simultaneously finishes the end surfaces of both barrels and of rib 40.

While a preferred embodiment of the invention has been specifically shown and described, this was for purposes of illustration only, and not for purposes of limitation, the scope of the invention being in accordance with the hereinafter presented claims.

That which is claimed is:

1. A method of simultaneously finishing the muzzle end surfaces of both barrels of a double-barrel shotgun or similar firearm by use of a gunsmith's tool including an elongate shank adapted to undergo rotation about its central axis when driven at one end portion, a generally cylindrical guide member releasably and concentrically secured upon the other end portion of the tool shank and closely receivable within one of the firearm barrels through the muzzle thereof, file means connected to and projecting radially outwardly from a medial portion of the tool shank a distant sufficient for the file means to overlie the muzzle end surfaces of both of the barrels of the firearm when the tool shank is axially aligned with one of the barrels, comprising the steps of:

inserting the guide member of the tool into one barrel of the firearm through the muzzle thereof to axially align the tool shank and the barrel and to establish engagement between the file means of the tool and the muzzle end surfaces of both of the barrels of the firearm;

maintaining the guide member within the one of the barrels and maintaining engagement of the file means with the muzzle end surfaces of both of the barrels of the firearm while rotating the shank of the tool and the thereto-secured file means about the central axis of the tool shank, to thereby simultaneously effect finishing by the file means of the muzzle end surfaces of both barrels of the firearm.

2. A gunsmith's tool for surface finishing the muzzle of a barrel of a shotgun or similar firearm, comprising;

an elongate shank adapted to be rotated about its central axis;

drive means upon one end portion of said shank for imparting said rotation to it;

a smooth-surfaced and generally cylindrical guide member closely receivable within said barrel of said firearm through said muzzle thereof; said guide member being formed of wear-resistant plastic material and having a blind bore extending axially thereof through one of its ends; the other end portion of said shank being concentrically received within and abutting the bottom of said bore; and threaded fastener means extending through the other end of said guide member and into threaded engagement with said shank for releasably securing said guide member upon and in concentric relationship with said other end portion of said shank;

file means connected to and projecting radially outwardly from a medial portion of said shank into overlying engagement with the end surfaces of said muzzle of said firearm, when said guide member is received within said barrel thereof, for rotative movement with said shank relative to said muzzle surfaces overlaid and engaged thereby;

a backing plate permanently fixedly secured to and projecting radially outwardly from said medial portion of said shank for rotation therewith; said file means being supportively and completely overlaid by said backing plate and being rotatable in unison with it.

3. A tool as in claim 2, wherein said file means is spaced vertically along the length of said shank from said guide member.

4. A tool as in claim 3, wherein said backing plate and said file means are each of circular disc-like shape.

5. A tool as in claim 4, and further including a plurality of releasable fastener elements releasably securing said file means to said backing plate.

6. A tool as in claim 2, wherein said firearm includes a second barrel connected to and extending in generally parallel and coextensive relationship with said first-mentioned barrel; and wherein said file means projects sufficiently radially outwardly from said shank to overlie and engage the muzzle end surfaces of each of said barrels of said firearm upon reception of said guide member in either of said barrels, and to simultaneously finish the muzzle end surfaces of both of said barrels upon rotation of said shank.

7. A tool as in claim 6, wherein said file means comprises a disc-like member having filing teeth upon a surface thereof overlying and engaging said muzzle end surfaces of said barrels of said firearm.

8. A tool as in claim 7, and further including releasable fastener means releasably securing said disc-like member to said backing plate.

* * * * *